United States Patent [19]

Curry

[11] 4,019,063

[45] Apr. 19, 1977

[54] RADIOGRAPHIC EXAMINATION APPARATUS

[76] Inventor: Leonard O. Curry, P.O. Box 152, Nevada, Mo. 64772

[22] Filed: Mar. 17, 1976

[21] Appl. No.: 667,509

[52] U.S. Cl. ..... 250/523; 313/58

[51] Int. Cl.[2] ..... H01J 7/44

[58] Field of Search ..... 250/523; 313/58

[56] References Cited

UNITED STATES PATENTS 3,473,028 10/1969 Curry ..... 250/523

*Primary Examiner*—Alfred E. Smith
*Assistant Examiner*—T. N. Grigsby
*Attorney, Agent, or Firm*—Fishburn, Gold & Litman

[57] ABSTRACT

A radiographic examination apparatus for exposing photographic film includes an economical assembly of radiation emission means and electrical transformer means operatively connected together and mounted within an interior chamber of an elongated tubular disposable housing having first and second cap members mounted on respective opposite end portions of the tubular housing. Seal members are positioned in engagement with the tubular housing and with the first and second cap members for sealing same to retain an insulating medium within the housing. Gauge means and flow means are mounted on the housing and communicate with the interior chamber for measuring pressure therein and permit free circulation of an insulating medium to and from the interior chamber.

10 Claims, 5 Drawing Figures

Fig. 3.
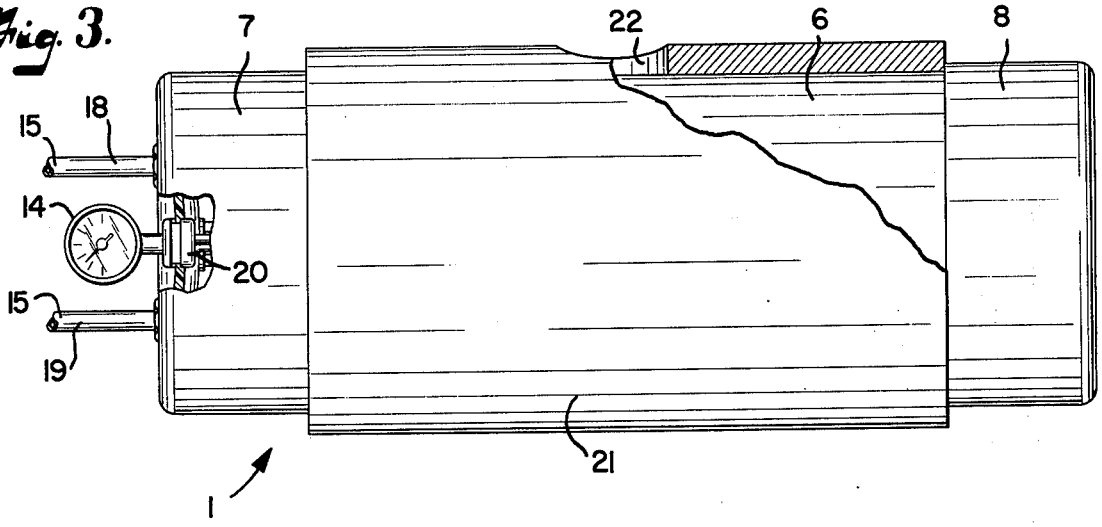
Fig. 4.
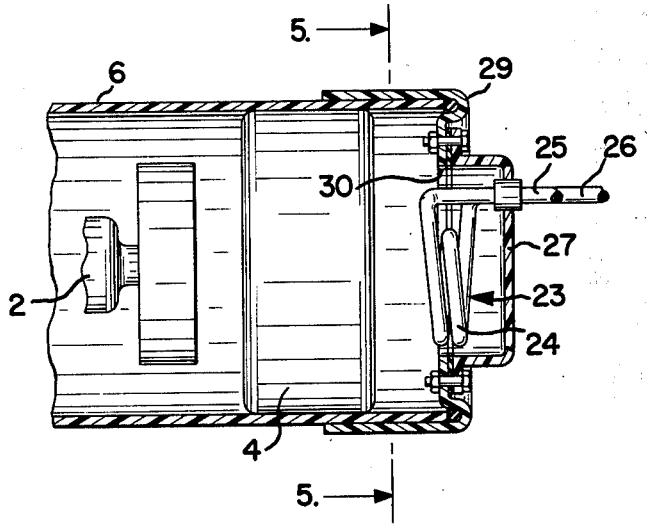
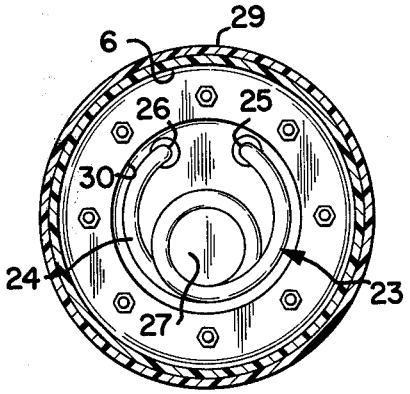
Fig. 5.

RADIOGRAPHIC EXAMINATION APPARATUS

The present invention relates to the field of radiographic examination and more particularly to an apparatus for exposing photographic film during the radiographic inspection of the quality of welds, structural sections and the like.

The principal objects of the present invention are: to provide a radiographic examination apparatus particularly adapted for field use and which is portable and easily maneuvered; to provide such a radiographic examination apparatus which is relatively small, light, and easily handled when used for field examination of pipe welds, building structure, and the like; to provide such a radiographic examination apparatus having an economical assembly of a disposable elongated tubular housing with cap members on opposite end portions whereby the unit may be supported in an upright position on one of the cap members; to provide such a radiographic examination apparatus wherein the housing is formed of X-ray transparent material which may be easily cut to open the housing for removal of the operative components all in less time and with less labor than removing operative components from a conventional radiographic examining apparatus; to provide such an apparatus having X-ray opaque shield material mounted on an exterior surface of the housing and having a window through which X-rays can pass for exposing photographic film; to provide such an X-ray examination apparatus adapted to use three hundred sixty degree (360°) X-ray tubes or directional X-ray tubes; to provide such a radiographic examination apparatus having a pressure gauge and flow means connected to one end cap of the housing for circulation of an insulating medium to and from an interior chamber of the housing; and to provide such a radiographic examination apparatus which is economical to manufacture, durable in construction, positive in operation, and particularly well adapted for the proposed use.

Other objects and advantages of this invention will become apparent from the following decription taken in connection with the accompanying drawings wherein are set forth, by way of illustration and example, certain embodiments of this invention.

The drawings constitute a part of the specification and include an exemplary embodiment of the present invention and illustrate various objects and features of the radiographic examination apparatus.

FIG. 3 is an elevational view of the radiographic examination apparatus having shield material on the exterior of the housing.

FIG. 4 is a fragmentary longitudinal sectional view of a modified form of the radiographic examination apparatus having a cooling system with a cooling coil mounted in communication with the interior chamber of the housing for effectively transferring heat from an insulating medium within the housing.

FIG. 5 is a fragmentary transverse sectional view taken on line 5—5 of FIG. 4 and showing the cooling coil.

Figure 1:
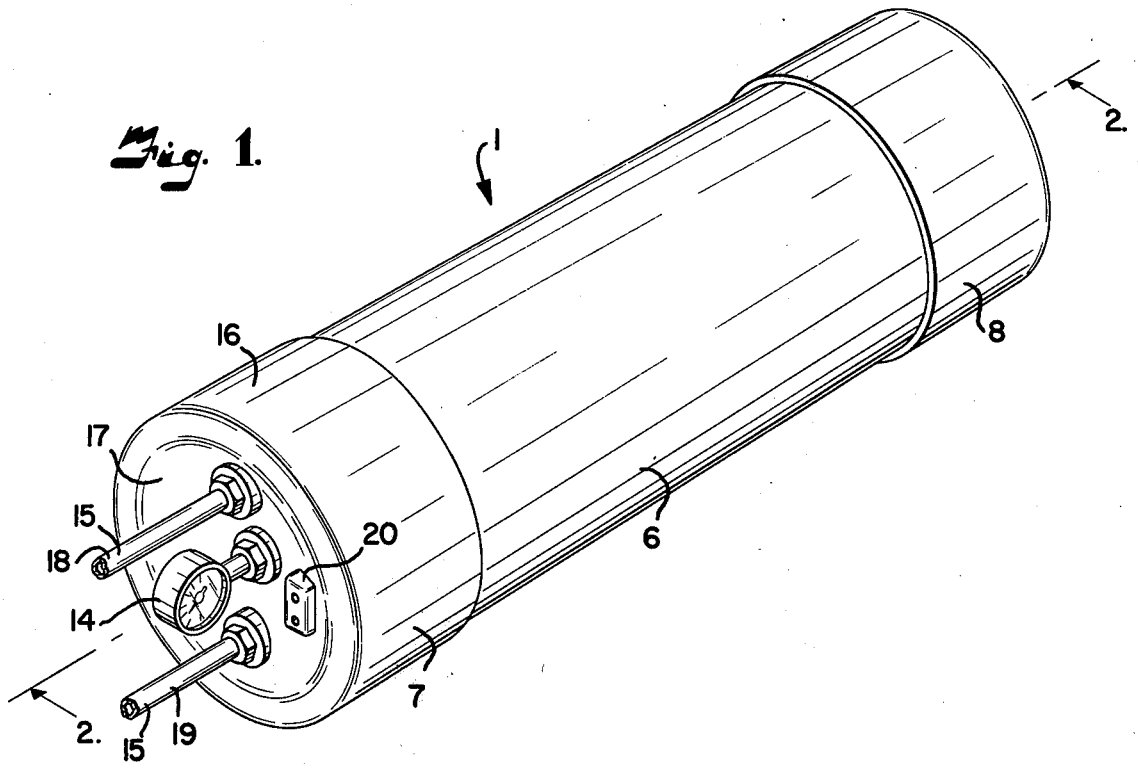
FIG. 1 is a perspective view of a radiographic examination apparatus embodying features of the present invention.
Figure 2:
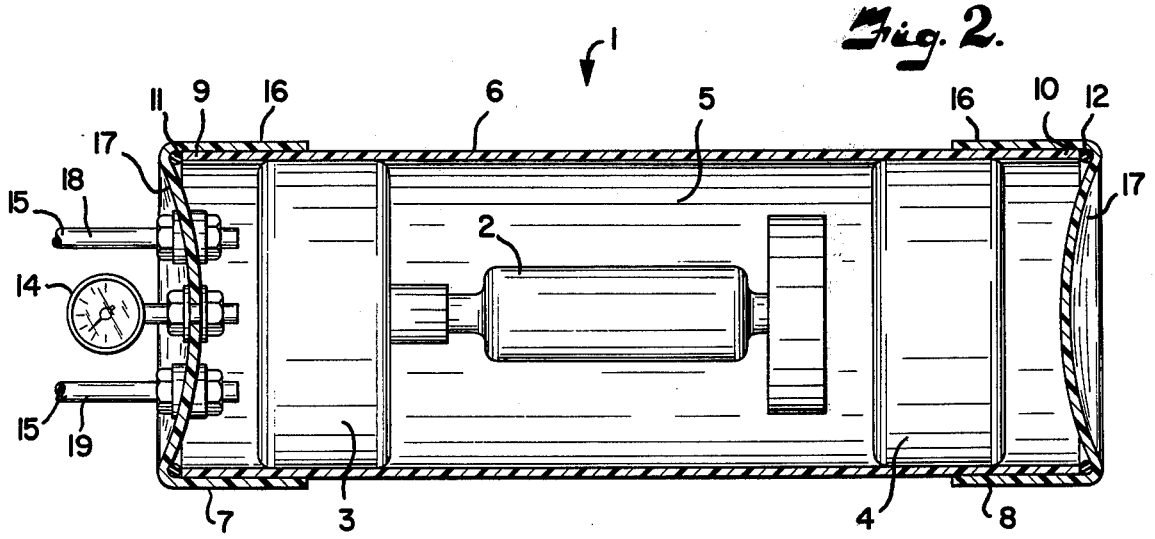
FIG. 2 is a longitudinal sectional view taken on line 2—2 of FIG. 1 and through a housing of the radiographic examination apparatus and showing disposition of electrical transformer means and radiation emission means in an interior chamber of the housing.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a radiographic examination apparatus for exposing photographic film. The apparatus 1 includes an economical assembly of radiation emission means 2 and electrical transformer means 3 and 4 operatively connected together and mounted within an interior chamber 5 of an elongated disposable tubular housing 6 having first and second cap members 7 and 8 mounted on respective opposite end portions 9 and 10 of the tubular housing 6. Seal members 11 and 12 are positioned in engagement with the tubular housing 6 and with the first and second cap members 7 and 8 for sealing same to retain an insulating medium within the housing 6. Gauge means 14 is mounted on the housing 6 and communicates with the interior chamber 5 for measuring pressure therein. Flow means 15 are mounted on the housing 6 and permit free circulation of an insulating medium to and from the interior chamber 5.

The housing 6 illustrated is an elongated tubular member of cylindrical form and of X-ray transparent material, such as polyvinylchloride or a suitable reinforced synthetic resin material having suitable resistance to heat with good dielectric qualities to thereby inhibit the possibility of arc-over or through housing walls. It is also important to employ such a material which will form a relatively light, durable, and heat resistant housing for ease of handling and yet of low cost to be disposable in the event of failure of any component therein.

The cap members 7 and 8 are also preferably formed of the same material as the housing 6. The first and second cap members 7 and 8 each have a side wall or flange portion 16 extending from an end wall 17. The radiographic examination apparatus 1 is adapted to be supported on one of the cap members with the housing 6 in an upstanding position. In the illustrated embodiment, the exterior surface of each end wall 17 is concave so that the peripheral edge portion thereof defines an annular ring or base for the radiographic examination apparatus 1.

The seal rings 11 and 12 are in engagement with the cap members 7 and 8 and with the end portions 9 and 10 respectively of the housing 6 to permit the insulating medium to be retained under pressure within the housing 6. The seal rings 11 and 12 are preferably formed of resilient material which is chemically inert or has a high or great resistance to the insulating medium and resistance to heat. In the illustrated embodiment, the seal rings 11 and 12 are positioned in engagement with respective opposite end edges of the side wall of the housing 6 and are received in a pocket formed by the intersection of the respective side wall or flange 16 and the end wall 17 of the respective cap member.

The insulating medium may be any fluid, such as a liquid or gas, which will absorb heat within the housing 6 and release heat when passed through a heat exchange means (not shown) to effect transfer of heat before recirculation of the insulating medium through the housing 6. Insulating gas is preferred for the radiographic examination apparatus 1 so that the weight may be maintained at a minimum value and expansion of the heated gas only increases pressure within the housing 6 whereas expansion of oil or other liquid would require means within the housing to absorb the expansion, such as a bellows or the like.

Oil or gas is circulated through the flow means 15 which are illustrated as being in the form of first and second flow members 18 and 19 for inflow to and outflow from the housing 6 of the insulating medium respectively.

The gauge means 14 is mounted on or in one of the end cap members 7 and 8, for example, the end cap 7, and is operative to measure pressure within the housing 6. It may also be desirable to measure temperature of the insulating medium within the housing 6, therefore, the gauge means 14 may also include a thermometer.

One of the end cap members, for example the end cap member 7 having the gauge means 14 mounted thereon, has means mounted thereon for permitting electrical connection of the emission means 2 and the transformer means 3 and 4 to a source of electrical power. In the illustrated embodiment, a receptacle 20 is mounted in the end cap member 7 and is capable of receiving prongs of a suitable plug of an electrical extension cord. Suitable electrical wiring within the housing electrically connects the receptacle 20 and the emission means 2 and the transformer means 3 and 4.

The radiographic examination apparatus 1 is capable of exposing photographic film in position in any desired location around the housing 6 when the X-ray tube 2 of the emission means is a three hundred sixty degree (360°) tube. The radiographic examination apparatus 1 may be made directional by use of a directional X-ray tube 2. When the directional X-ray tube 2 is employed, indicia means in the form of a window designation, such as a circle, is printed on the exterior surface of the housing 6 in alignment with the window of the directional X-ray tube 2.

When using the radiographic examination apparatus 1 in certain locations, such as within pump houses, or within like enclosures wherein it is difficult to maintain a safe distance between the apparatus 1 and operating personnel, it may be desired to provide a suitable X-ray opaque shield material 21, such as lead. The shield material 21 may be suitably secured, as by being glued, to the exterior surface of the housing 6. The shield material 21 has a window 22 through which X-rays can pass.

Operation of the radiographic examination apparatus 1 for extended periods of time may raise temperatures within the interior chamber 5 to a level above which the insulating medium ceases to be effective to prevent over-arc of high voltage transformer means 3 and 4. FIGS. 4 and 5 illustrate a cooling system 23 having a cooling coil 24 mounted in communication with the interior chamber 5 of the housing 6 for effectively transferring heat from the insulating medium within the housing 6. The cooling coil 24 has an inlet tube 25 and an outlet tube 26 for passage therethrough of a coolant. The cooling coil 24 is housed in a protruding cap-like housing or structure 27 which is operatively mounted in any suitable manner, as by plurality of nut and bolt assemblies, to the end wall 17 of a modified cap member 29 and surrounding an aperture 30 therein to thereby provide communication between the interior chamber 5 of the housing 6 and the cooling housing 27 having the cooling coil 24 therein.

As a result of the new and novel housing structure embodying the features of the present invention, the radiographic examination apparatus 1 may be utilized in a substantially continuous manner without periods of shutdown to allow for equipment cooling. The novel housing also results in the capability of employing such X-ray equipment in a continuous manner without the requirement of separate cooling systems in addition to the heat transfer system employed in circulation of the insulating medium, such as a dielectric gas throughout the interior chamber 5 of the housing 6 under normal temperature conditions. Further, even under abnormal conditions the X-ray equipment may be operated substantially continuously with the cooling system 23 to effect continuous inspection operations under acceptable safe standards. The novel housing allows for the construction of an apparatus 1 weighing 30 to 80 pounds which is smaller in size than prior art apparatus of this nature.

The emission means 2 is illustrated as an X-ray tube which may be any suitable size and type as determined by the use of the radiographic examining apparatus 1. For example, an industrial X-ray tube having 160 kvp hooded anode type X-ray tube may be suitably employed for the radiographic examination apparatus 1 when used for inspection of welds in pipe lines and pipe station installations. The transformer means 3 and 4 may also be any suitable size and type as determined by the use of the apparatus 1. The transformers 3 and 4 preferably have suitable cores having the X-ray tube 2 operatively connected thereto, as by a center grounded self-rectified or half wave circuit for provision of high voltage to the X-ray tube 2.

Suitable means are provided for supporting the X-ray tube 2 within the housing 6 and for retaining the X-ray tube 2 in a desired relative position with the interior chamber 5 of the housing 6. Suitable means are provided on or in the housing 6 for supporting and retaining the transformer means 3 and 4 in the desired relative positions within the interior chamber 5 of the housing 6.

It is to be understood that while I have illustrated and described certain forms of my invention, it is not to be limited to these specific forms or arrangement of parts herein described and shown.

What I claim and desire to secure by Letters Patent is:

1. A radiographic examination apparatus comprising:

a. an elongated tubular housing having a side wall and opposite end portions;

b. first and second cap members each mounted on a respective one of the end portions of said housing to close same and define an interior chamber;

c. seal means for and in engagement with each of the opposite end portions of said housing and with said respective first and second cap members;

d. radiation emission means for exposure of photographic film including means for retaining said emission means in a desired relative position within the interior chamber of said housing;

e. electrical transformer means operatively coupled to said radiation emission means and including means for retaining said transformer means in a desired position within said chamber; and f. an insulating medium within said housing and gauge means mounted on one of said housing and cap members for measuring pressure within said housing.

2. A radiographic examination apparatus as set forth in claim 1 wherein one of said first and second cap members has means mounted thereon for permitting electrical connection of said emission means and transformer means to a source of electrical power whereby said housing may be supported on the other of said first and second cap members.

3. A radiographic examination apparatus as set forth in claim 1 including shield material mounted on the side wall of said housing, said shield material being X-ray opaque and having a window through which X-rays can pass.

4. A radiographic examination apparatus as set forth in claim 1 including a cooling system having a cooling coil mounted in communication with the interior chamber of said housing for effectively transferring heat from said insulating medium within said housing.

5. A radiographic examination apparatus as set forth in claim 1 including:

a. means mounted on one of said first and second cap members for permitting electrical connection of said emission means and transformer means to a source of electrical power whereby said housing may be supported on the other of said first and second cap members;

b. shield material mounted on the side wall of said housing, said shield material being X-ray opaque and having a window through which X-rays can pass; and c. a cooling system having a cooling coil mounted in communication with the interior chamber of said housing for effectively transferring heat from said insulating medium within said housing.

6. A radiographic examination apparatus comprising:

a. an elongated tubular housing having a side wall and opposite end portions, each of said opposite end portions having a respective end edge;

b. first and second cap members each mounted on a respective one of the end portions of said housing to close same and define an interior chamber;

c. first and second seal means each in engagement with the end edge of a respective one of said end portions of said housing and with a respective one of said first and second cap members;

d. radiation emission means for exposure of photographic film including means for retaining said emission means in a desired relative position within the interior chamber of said housing;

e. electrical transformer means operatively coupled to said radiation emission means and including means for retaining said transformer means in a desired position within said chamber;

f. said tubular housing and cap members being disposable and replaceable for repair of components therein; and g. an insulatng medium within said housing and gauge means mounted on one of said housing and said first and second cap members for measuring pressure within said housing.

7. A radiographic examination apparatus as set forth in claim 6 wherein:

a. said gauge means is mounted on one of said first and second cap members; and b. said one cap member has means mounted thereon for permitting electrical connection of said emission means and transformer means to a source of electrical power whereby said housing may be supported on the other of said first and second cap members.

8. A radiographic examination apparatus as set forth in claim 6 including shield material mounted on the side wall of said housing, said shield material being X-ray opaque and having a window through which X-rays can pass.

9. A radiographic examination apparatus as set forth in claim 6 including a cooling system having a cooling coil mounted in communication with the interior chamber of said housing for effectively transferring heat from said insulating medium within said housing.

10. A radiographic examination apparatus as set forth in claim 9 wherein:

a. said gauge means is mounted on one of said first and second cap members;

b. said one cap member has means mounted thereon for permitting electrical connection of said emission means and transformer means to a source of electrical power whereby said housing may be supported on the other of said first and second cap members;

c. said side wall of said housing has shield material mounted thereon;

d. said shield material is X-ray opaque and has a window through which X-rays can pass; and e. the interior chamber of said housing has a cooling system therein with a cooling coil mounted in communication with the interior chamber of said housing for effectively transferring heat from said insulating medium within said housing.

* * * * *